US010488105B2

(12) United States Patent
Pierre, Jr. et al.

(10) Patent No.: US 10,488,105 B2
(45) Date of Patent: Nov. 26, 2019

(54) METHOD AND SYSTEM FOR SEPARATING NITROGEN FROM LIQUEFIED NATURAL GAS USING LIQUEFIED NITROGEN

(71) Applicants: Fritz Pierre, Jr., Humble, TX (US); Richard A. Huntington, Spring, TX (US)

(72) Inventors: Fritz Pierre, Jr., Humble, TX (US); Richard A. Huntington, Spring, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 98 days.

(21) Appl. No.: 15/347,968

(22) Filed: Nov. 10, 2016

(65) Prior Publication Data

US 2017/0167788 A1 Jun. 15, 2017

Related U.S. Application Data

(60) Provisional application No. 62/266,976, filed on Dec. 14, 2015.

(51) Int. Cl.
*F25J 3/02* (2006.01)

(52) U.S. Cl.
CPC ..... *F25J 3/0214* (2013.01); *F25J 3/0257* (2013.01); *F25J 2210/06* (2013.01); *F25J 2220/50* (2013.01)

(58) Field of Classification Search
CPC ..... F25J 3/0214; F25J 3/0257; F25J 2210/62; F25J 2210/60; F25J 2210/42; F25J 2220/60; F25J 3/0209; F25J 3/0233
See application file for complete search history.

(56) References Cited

U.S. PATENT DOCUMENTS 3,180,709 A 4/1965 Yendall et al. ..... 23/210
3,347,055 A 10/1967 Blanchard et al. ..... 62/9
(Continued)

FOREIGN PATENT DOCUMENTS

CN 102628635 10/2014
DE 1960515 5/1971
(Continued)

OTHER PUBLICATIONS

U.S. Appl. No. 15/347,983, filed Nov. 10, 2016, Pierre, Fritz Jr. et al.
(Continued)

*Primary Examiner* — Brian M King
(74) *Attorney, Agent, or Firm* — ExxonMobil Upstream Research Company—Law Department

(57) ABSTRACT

A method for separating nitrogen from an LNG stream with a nitrogen concentration of greater than 1 mol %. A pressurized LNG stream is produced at a liquefaction facility by liquefying natural gas, where the pressurized LNG stream has a nitrogen concentration of greater than 1 mol %. At least one liquid nitrogen (LIN) stream is received from storage tanks, the at least one LIN stream being produced at a different geographic location from the LNG facility. The pressurized LNG stream is separated in a separation vessel into a vapor stream and a liquid stream. The vapor stream has a nitrogen concentration greater than the nitrogen concentration of the pressurized LNG stream. The liquid stream has a nitrogen concentration less than the nitrogen concentration of the pressurized LNG stream. At least one of the one or more LIN streams is directed to the separation vessel.

24 Claims, 8 Drawing Sheets

(56) References Cited

U.S. PATENT DOCUMENTS

| | | | | |
|---|---|---|---|---|
| 3,370,435 | A | 2/1968 | Arregger | 62/28 |
| 3,400,547 | A * | 9/1968 | Williams | B63B 25/08 62/50.1 |
| 3,724,226 | A | 4/1973 | Pachaly | 62/39 |
| 3,878,689 | A | 4/1975 | Grenci | 62/9 |
| 4,415,345 | A | 11/1983 | Swallow | 62/28 |
| 5,025,860 | A | 6/1991 | Mandrin | 166/267 |
| 5,137,558 | A | 8/1992 | Agrawal | 62/24 |
| 5,139,547 | A | 8/1992 | Agrawal et al. | 62/8 |
| 5,141,543 | A | 8/1992 | Agrawal et al. | 62/8 |
| 5,638,698 | A | 6/1997 | Knight et al. | 62/632 |
| 5,950,453 | A | 9/1999 | Bowen et al. | 62/612 |
| 6,003,603 | A | 12/1999 | Breivik et al. | 166/357 |
| 6,295,838 | B1 | 10/2001 | Shah et al. | 62/643 |
| 6,298,688 | B1 | 10/2001 | Brostow et al. | 62/613 |
| 6,412,302 | B1 | 7/2002 | Foglietta | 62/611 |
| 6,662,589 | B1 | 12/2003 | Roberts et al. | 62/425 |
| 7,143,606 | B2 | 12/2006 | Trainer | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 7,712,331 | B2 | 5/2010 | Dee et al. | 62/612 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,646,289 | B1 | 2/2014 | Shivers, III et al. | 62/611 |
| 9,016,088 | B2 | 4/2015 | Butts | 62/613 |
| 9,422,037 | B2 | 8/2016 | VanWijngaarden et al. | 114/74 |
| 9,435,229 | B2 | 9/2016 | Alekseev et al. | 60/643 |
| 9,459,042 | B2 | 10/2016 | Chantant et al. | 62/50.2 |
| 2003/0226373 | A1 | 12/2003 | Prible et al. | 62/612 |
| 2004/0050095 | A1 * | 3/2004 | Brigham | F25J 3/04254 62/643 |
| 2006/0000615 | A1 | 1/2006 | Choi | 166/352 |
| 2009/0217701 | A1 | 9/2009 | Minta et al. | 62/612 |
| 2010/0192626 | A1 | 8/2010 | Chantant | 62/606 |
| 2010/0192627 | A1 | 8/2010 | Briend | 62/620 |
| 2010/0251763 | A1 | 10/2010 | Audun | 62/614 |
| 2011/0036121 | A1 | 2/2011 | Roberts et al. | 62/612 |
| 2011/0126451 | A1 | 6/2011 | Pan et al. | 44/451 |
| 2011/0259044 | A1 | 10/2011 | Baudat et al. | 62/611 |
| 2012/0285196 | A1 | 11/2012 | Flinn et al. | 62/620 |
| 2013/0199238 | A1 | 8/2013 | Mock et al. | 62/611 |
| 2014/0130542 | A1 | 5/2014 | Brown et al. | 62/612 |
| 2015/0285553 | A1 | 10/2015 | Oelfke et al. | 62/611 |
| 2015/0308737 | A1 * | 10/2015 | Chen | F25J 3/061 62/623 |
| 2015/0308738 | A1 * | 10/2015 | Ott | F25J 1/0022 62/623 |
| 2017/0010041 | A1 | 1/2017 | Pierre, Jr. et al. | 62/616 |
| 2017/0016667 | A1 | 1/2017 | Huntington et al. | 62/614 |

FOREIGN PATENT DOCUMENTS

| | | | |
|---|---|---|---|
| DE | 2354726 | 5/1975 | F17C 9/04 |
| DE | 19906602 | 8/2000 | C10G 5/06 |
| DE | 102013007208 | 10/2014 | B01D 3/14 |
| EP | 1972875 | 9/2008 | |
| FR | 2756368 | 5/1998 | |
| GB | 1376678 | 12/1974 | |
| GB | 1596330 | 8/1981 | F25J 1/02 |
| GB | 2172388 | 9/1986 | |
| GB | 2333148 | 7/1999 | |
| GB | 2470062 | 11/2010 | F25J 1/02 |
| GB | 2486036 | 11/2012 | F25J 1/02 |
| JP | S9216785 | 12/1984 | F17C 13/00 |
| WO | WO2006/120127 | 11/2006 | F25J 3/02 |
| WO | WO2015/110443 | 7/2015 | |

OTHER PUBLICATIONS

U.S. Appl. No. 15/348,004, filed Nov. 10, 2016, Pierre, Fritz Jr. et al.

U.S. Appl. No. 15/348,533, filed Nov. 10, 2016, Pierre, Fritz Jr.

U.S. Appl. No. 62/458,127, filed Feb. 13, 2017, Pierre, Fritz Jr.

U.S. Appl. No. 62/458,131, filed Feb. 13, 2017, Pierre, Fritz Jr.

U.S. Appl. No. 62/463,274, filed Feb. 24, 2017, Kaminsky, Robert D. et al.

U.S. Appl. No. 62/478,961, Balasubramanian, Sathish.

Publication No. 43031 (2000) Research Disclosure, Mason Publications, Hampshire, GB, Feb. 1, 2000, p. 239, XP000969014, ISSN: 0374-4353, paragraphs [0004], [0005] & [0006].

Publication No. 37752 (1995) Research Disclosure, Mason Publications, Hampshire, GB, Sep. 1, 1995, p. 632, XP000536225, ISSN: 0374-4353, 1 page.

Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.

U.S. Appl. No. 15/182,050, filed Jun. 14, 2016, Pierre Jr., Fritz et al.

* cited by examiner

METHOD AND SYSTEM FOR SEPARATING NITROGEN FROM LIQUEFIED NATURAL GAS USING LIQUEFIED NITROGEN

CROSS REFERENCE TO RELATED APPLICATIONS

This application claims the benefit of U.S. Provisional Patent Application 62/266,976, filed Dec. 14, 2015 entitled METHOD AND SYSTEM FOR SEPARATING NITROGEN FROM LIQUEFIED NATURAL GAS USING LIQUEFIED NITROGEN, the entirety of which is incorporated by reference herein.

This application is related to U.S. Provisional Patent Application No. 62/266,979 titled "Expander-Based LNG Production Processes Enhanced With Liquid Nitrogen;" U.S. Provisional Patent Application No. 62/266,983 titled "Method of Natural Gas Liquefaction on LNG Carriers Storing Liquid Nitrogen;" and U.S. Provisional Patent Application No. 62/622,985 titled "Pre-Cooling of Natural Gas by High Pressure Compression and Expansion," all having common inventors and assignee and filed on an even date herewith, the disclosure of which is incorporated by reference herein in their entirety.

BACKGROUND

Field of Disclosure

The disclosure relates generally to the field of natural gas liquefaction to form liquefied natural gas (LNG). More specifically, the disclosure relates to the separation of nitrogen from an LNG stream.

Description of Related Art

This section is intended to introduce various aspects of the art, which may be associated with the present disclosure. This discussion is intended to provide a framework to facilitate a better understanding of particular aspects of the present disclosure. Accordingly, it should be understood that this section should be read in this light, and not necessarily as an admission of prior art.

LNG is a rapidly growing means to supply natural gas from locations with an abundant supply of natural gas to distant locations with a strong demand for natural gas. The conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) removal of light components from the LNG such as nitrogen and helium; e) transport of the LNG product in ships or tankers designed for this purpose to a market location; and f) re-pressurization and regasification of the LNG at a regasification plant to form a pressurized natural gas stream that may be distributed to natural gas consumers. Step c) of the conventional LNG cycle usually requires the use of large refrigeration compressors often powered by large gas turbine drivers that emit substantial carbon and other emissions. Large capital investments in the billions of US dollars and extensive infrastructure are required as part of the liquefaction plant. Step f) of the conventional LNG cycle generally includes re-pressurizing the LNG to the required pressure using cryogenic pumps and then re-gasifying the LNG to form pressurized natural gas by exchanging heat through an intermediate fluid but ultimately with seawater or by combusting a portion of the natural gas to heat and vaporize the LNG. Generally, the available exergy of the cryogenic LNG is not utilized.

A relatively new technology for producing LNG is known as floating LNG (FLNG). FLNG technology involves the construction of the gas treating and liquefaction facility on a floating structure such as barge or a ship. FLNG is a technology solution for monetizing offshore stranded gas where it is not economically viable to construct a gas pipeline to shore. FLNG is also increasingly being considered for onshore and near-shore gas fields located in remote, environmentally sensitive and/or politically challenging regions. The technology has certain advantages over conventional onshore LNG in that it has a lower environmental footprint at the production site. The technology may also deliver projects faster and at a lower cost since the bulk of the LNG facility is constructed in shipyards with lower labor rates and reduced execution risk.

Although FLNG has several advantages over conventional onshore LNG, significant technical challenges remain in the application of the technology. For example, the FLNG structure must provide the same level of gas treating and liquefaction in an area that is often less than a quarter of what would be available for an onshore LNG plant. For this reason, there is a need to develop technology that reduces the footprint of the FLNG plant while maintaining the capacity of the liquefaction facility to reduce overall project cost.

Nitrogen is found in many natural gas reservoirs at concentrations greater than 1 mol %. The liquefaction of natural gas from these reservoirs often necessitate the separation of nitrogen from the produced LNG to reduce the concentration of nitrogen in the LNG to less than 1 mol %. Stored LNG with a nitrogen concentration greater than 1 mol % has a higher risk for auto-stratification and rollover in the storage tanks. This phenomenon leads to rapid vapor release from the LNG in the storage tanks, which is a significant safety concern.

For LNG with a nitrogen concentration less than 2 mol %, sufficient nitrogen separation from the LNG may occur when the pressurized LNG from the hydraulic turbine is expanded by flowing through a valve to a pressure at or close to the LNG storage tank pressure. The resulting two-phase mixture is separated in an end-flash gas separator into a nitrogen rich vapor stream, often referred to as end-flash gas, and a LNG stream with nitrogen concentration less than 1 mol %. The end-flash gas is compressed and incorporated into the fuel gas system of the facility where it can be used to produce process heat, generate electrical power and/or generate compression power. For LNG with a nitrogen concentration greater than 2 mol %, using a simple end-flash gas separator would require an excessive end-flash gas flow rate to sufficiently reduce the nitrogen concentration in the LNG stream. In such cases, a fractionation column may be used to separate the two-phase mixture into the end-flash gas and the LNG stream. The fractionation column will typically comprise or be incorporated with a reboiler system to produce stripping gas that is directed to bottom stages of the column to reduce the nitrogen level in the LNG stream to less than 1 mol %. In a typical design of this fractionation column with reboiler, the reboiler heat duty is obtained by indirect heat transfer of column's liquid bottom with the pressurized LNG stream before the pressurized LNG stream is expanded in the inlet valves of the fractionation column.

The fractionation column provides a more efficient method for separating nitrogen from the LNG stream compared to a simple end-flash separator. However, the resulting end-flash gas from the column overhead will include a significant concentration of nitrogen. The end-flash gas serves as the primary fuel for the gas turbines in a typical LNG plant. Gas turbines, such as aero derivative gas turbines, may have restrictions on the concentration of nitrogen in the fuel gas of no greater than 10 or 20 mol %. The end-flash gas from the fractionation column overhead may have a nitrogen concentration significantly greater than the concentration limits of a typical aero-derivative gas turbine. For example, a pressurized LNG stream with nitrogen concentration of approximately 4 mol % will produce a column overhead vapor with a nitrogen concentration greater than 30 mol %. End-flash gas with a high nitrogen concentration is often directed to a nitrogen rejection unit (NRU). In the NRU, the nitrogen is separated from the methane to produce a) a nitrogen stream that is sufficiently low in hydrocarbons that it can be vented to the atmosphere and b) a methane-rich stream with a reduced nitrogen concentration to make it suitable for use as a fuel gas. The need for an NRU increases the amount of process equipment and the footprint of the LNG plant. The increase in equipment and footprint comes at high capital cost for offshore LNG projects and/or in remote area LNG projects.

The need for an NRU may be avoided for certain conditions when the end-flash gas has a high nitrogen concentration. It has been demonstrated that some aero derivative gas turbines may operate using end-flash gas with a high nitrogen concentration if the end-flash gas is compressed to a higher pressure than what is typically required by the gas turbine. For example, it has been shown that a Trent-60 aero derivative gas turbine can operate with a fuel gas comprising up to 40 mol % of nitrogen if its combustion pressure is increased from the typical 50 bar to approximately 70 bar. In this case, a higher pressure fuel gas system provides an alternative approach to the use of an NRU. This alternative approach has the advantage of eliminating all the equipment and added footprint of an NRU. However, it has the disadvantage of increasing the required power for end-flash gas compression and/or fuel gas compression. Additionally, this alternative approach has the disadvantage of not being as flexible to changes in the nitrogen concentration of LNG compared to the flexibility of operation provided by the NRU.

FIG. 1 depicts a conventional end-flash gas system 100 that may be used with an LNG liquefaction system. A pressurized LNG stream 102 from the main LNG cryogenic heat exchanger (not shown) flows through a hydraulic turbine 104 to partially reduce its pressure and further cool the pressurized LNG stream 102. The cooled pressurized LNG stream 106 is then subcooled in a reboiler 108 associated with an LNG fractionation column 110. The liquid bottom stream 112 of the LNG fractionation column 110 is partially vaporized in the reboiler 108 by exchanging heat with the cooled pressurized LNG stream 106. The vapors from the reboiler 108 are separated from the liquid stream and directed back to the LNG fractionation column 110 as a stripping gas stream 114 that is used to reduce the nitrogen level in the LNG stream 122 to less than 1 mol %. The subcooled pressurized LNG stream 116 is expanded in the inlet valves 118 of the LNG fractionation column to produce a two-phase mixture stream 120 with preferably a vapor fraction of less than 40 mol %, or more preferably less than 20 mol %. The two-phase mixture stream 120 is directed to the upper stages of the LNG fractionation column 110. The separated liquid from the reboiler 108 is an LNG stream 122 with less than 1 mol % nitrogen. The LNG stream 122 is then pumped to storage tanks (not shown) or other output. The gas in the overhead stream of the LNG fractionation column 110 is referred to as an end-flash gas stream 126. The end-flash gas stream 126 exchanges heat with a treated natural gas stream 128 in a heat exchanger 130 to condense the natural gas and produce an additional pressurized LNG stream 132 that may be mixed with the pressurized LNG stream 102. The warmed end-flash gas stream 134 exits the heat exchanger 130 and is compressed in a compression system 136 to a suitable pressure to be used as fuel gas 138.

The end-flash gas system 100 can produce LNG with a nitrogen concentration of less than 1 mol % while reducing the amount of end-flash gas that is produced. However, for pressurized LNG streams with a nitrogen concentration greater than 3 mol %, the end-flash gas nitrogen concentration may be greater than 20 mol %. The high nitrogen concentration in the end-flash gas may make it less suitable for use as a fuel gas for aero derivative gas turbines. Adding an NRU may be necessary to produce fuel gas of suitable methane concentration for use within the gas turbines.

FIG. 2 shows a system for nitrogen separation from LNG in an end-flash gas system 200, and is similar in structure to the system disclosed in U.S. Patent No. 2012/0285196. Like the end-flash gas system 100, a pressurized LNG stream 202 from the main LNG cryogenic heat exchanger (not shown) flows through a hydraulic turbine 204 to partially reduce its pressure and further cool the pressurized LNG stream 202. The cooled pressurized LNG stream 206 is then subcooled in a reboiler 208 associated with an LNG fractionation column 210. The liquid bottom stream 212 of the LNG fractionation column 210 is partially vaporized in the reboiler 208 by exchanging heat with the cooled pressurized LNG stream 206. The vapors from the column reboiler are separated from the liquid stream and directed back to the LNG fractionation column 210 as stripping gas stream 214 that is used to reduce the nitrogen level in the LNG stream to less than 1 mol %. The subcooled pressurized LNG stream 216 is expanded in the inlet valves 218 of the LNG fractionation column 210 to produce a two-phase mixture stream 220 with preferably a vapor fraction of less than 40 mol %, or more preferably less 20 mol %. The two-phase mixture stream 220 is directed to the upper stages of the LNG fractionation column 210. The separated liquid from the reboiler 208 is an LNG stream 222 with less than 1 mol % nitrogen. The LNG stream 222 may be directed to a first heat exchanger 224 where it is partially vaporized to provide a portion of the cooling duty for the column reflux stream 226. The partial vaporizing of the LNG stream 222 prior to its storage in an LNG tank 228 significantly increases the requirement of the boil-off gas (BOG) compressor 230. For example, the BOG volumetric flow rate to the BOG compressor 230 may be six times greater than that of a BOG compressor that follows a conventional end-flash gas system. The end-flash gas 232 from the LNG fractionation column 210 is first directed to the first heat exchanger 224 where it is warmed to an intermediate temperature by helping condense the column reflux stream 226. The intermediate temperature end-flash gas stream 234 is then split into a reflux stream 236 and a cold nitrogen vent stream 238. The reflux stream 236 may be compressed in a first reflux compressor 240 and cooled with the environment in a first cooler 242, and may be further compressed in a second reflux compressor 244 and cooled with the environment in a second cooler 246 to provide some of the refrigeration needed to produce the two-phase reflux stream 226 that enters the LNG fractionation column 210. The compressed and environmentally cooled reflux stream 248 is cooled further by indirect heat exchange with the cold nitrogen vent stream 238 in a second heat exchanger 250 to produce a cold reflux stream 252. The cold reflux stream 252 is then condensed and subcooled by indirect heat exchange with the LNG stream 222 and the end flash gas stream 234 in the first heat exchanger 224. The condensed and subcooled reflux stream 226 is expanded in the inlet valves 254 of the fractionation 210 column to produce a nitrogen-rich two-phase reflux stream 256 that enters the fractionation column 210.

The system shown in FIG. 2 adds a rectification section that enables the end-flash gas stream to have a methane concentration of less than 2 mol %, or more preferably less than 1 mol %, and subsequently allows for the venting of a portion of the end-flash gas to the environment as a nitrogen vent stream 258. The system shown in FIG. 2 produces a nitrogen vent stream and a low-nitrogen fuel gas stream without the addition of separate NRU system. For a pressurized LNG stream with a nitrogen concentration of 5 to 3 mol %, a conventional end-flash gas system will produce an end-flash gas with a nitrogen concentration greater than 20 mol % but less than 40 mol %. It has been shown that this high nitrogen content end-flash gas remains suitable for use in aero derivative gas turbine under the appropriate conditions. However, where a conventional end-flash gas system can still yield suitable fuel gas for burning in a gas turbine, the system shown in FIG. 2 has the disadvantage of requiring one-third more compression power than a conventional end-flash gas system. The system shown in FIG. 2 has the additional disadvantage that LNG production is reduced by approximately 6% when compared to a conventional end-flash gas system.

Known methods for separating nitrogen from LNG are challenged for offshore and/or remote area LNG projects. For this reason, there is a need to develop a method for separating nitrogen from an LNG stream comprising greater than 1 mol % nitrogen, where the method requires significantly less production site process equipment and footprint than previously described methods. There is a further need to develop an end-flash gas system that increases LNG production by recondensing the hydrocarbons in the end-flash gas and boil-off gas streams.

SUMMARY

The present disclosure provides a method for separating nitrogen from an LNG stream with a nitrogen concentration of greater than 1 mol %. A pressurized LNG stream is produced at a liquefaction facility by liquefying natural gas, where the pressurized LNG stream has a nitrogen concentration of greater than 1 mol %. At least one liquid nitrogen (LIN) stream is received from storage tanks, the at least one LIN stream being produced at a different geographic location from the LNG facility. The pressurized LNG stream is separated in a separation vessel into a vapor stream and a liquid stream. The vapor stream has a nitrogen concentration greater than the nitrogen concentration of the pressurized LNG stream. The liquid stream has a nitrogen concentration less than the nitrogen concentration of the pressurized LNG stream. At least one of the one or more LIN streams is directed to the separation vessel.

The present disclosure also provides a system for processing pressurized liquefied natural gas (LNG) produced at a liquefied natural gas (LNG) liquefaction facility, the LNG having a nitrogen concentration greater than 1 mol %. A separation vessel separates the pressurized LNG stream into a vapor stream and a liquid stream, where the vapor stream has a nitrogen concentration greater than the nitrogen concentration of the pressurized LNG stream and the liquid stream has a nitrogen concentration less than the nitrogen concentration of the pressurized LNG stream. A liquefied nitrogen (LIN) stream, produced at a different geographic location from the LNG liquefaction facility, is directed into the separation vessel.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
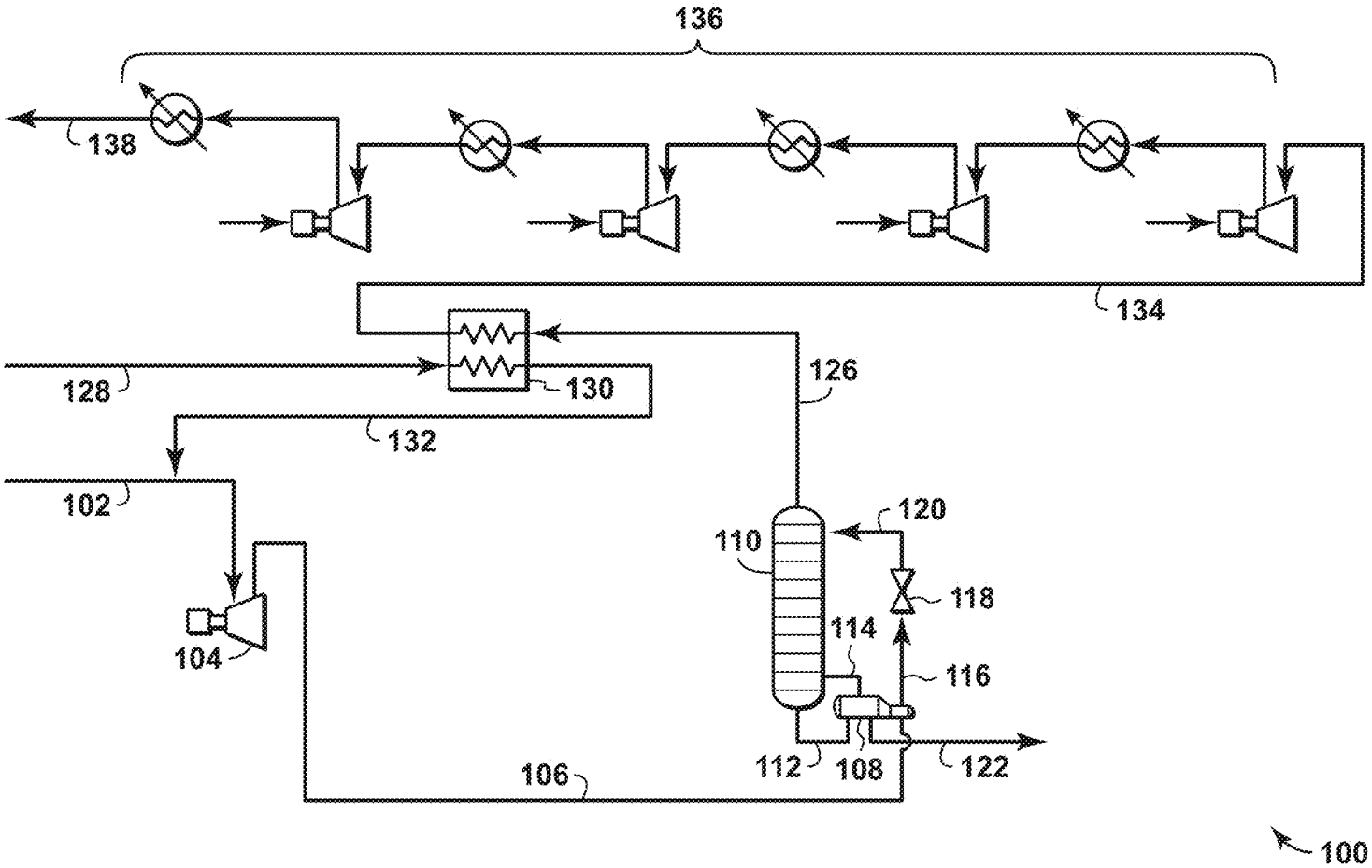
FIG. 1 (Prior Art)
FIG. 1 is a schematic diagram showing a known end-flash gas system.
Figure 2:
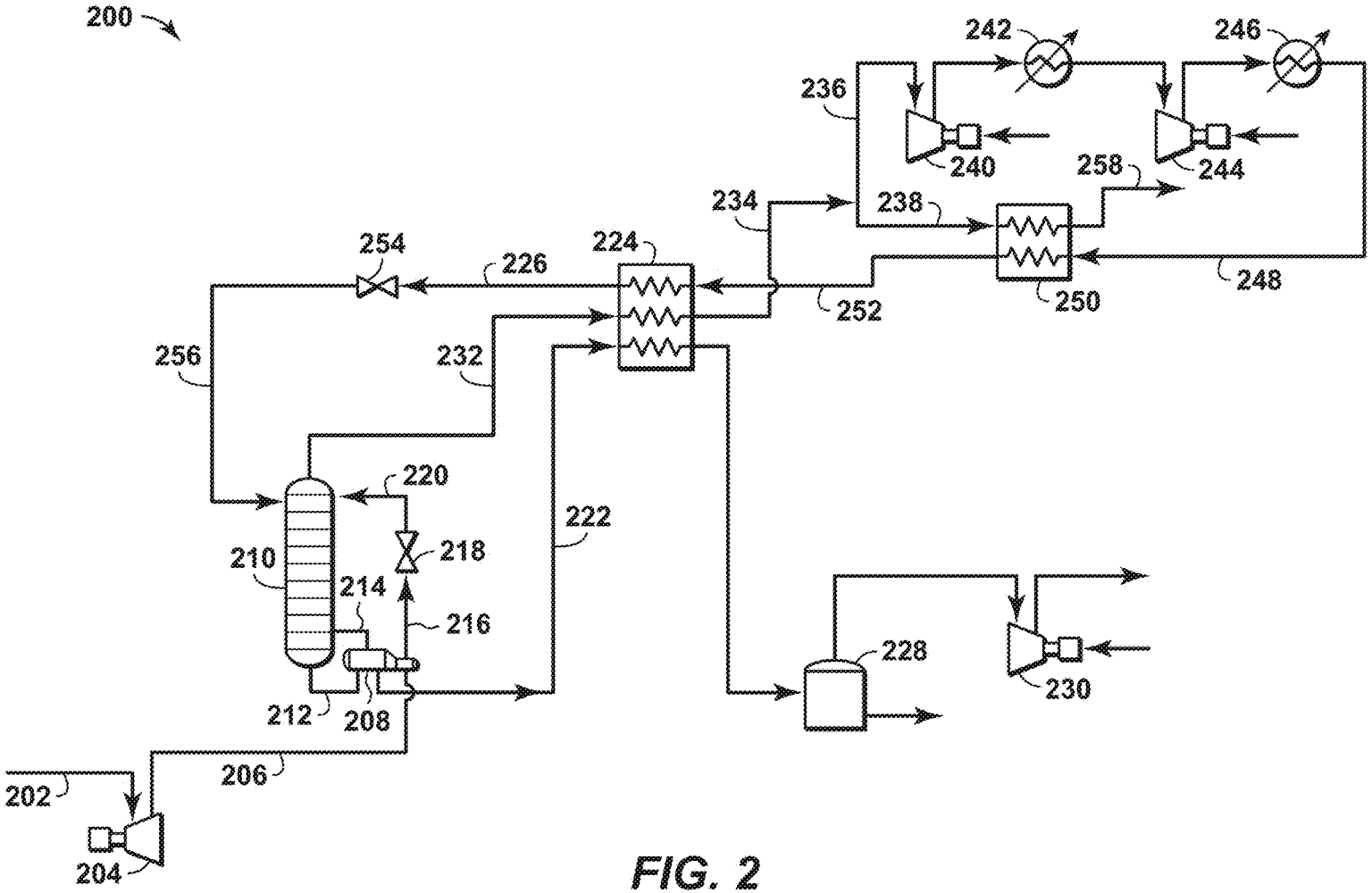
FIG. 2 (Prior Art)
FIG. 2 is a schematic diagram showing another known end-flash as system.

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

To promote an understanding of the principles of the disclosure, reference will now be made to the features illustrated in the drawings and specific language will be used to describe the same. It will nevertheless be understood that no limitation of the scope of the disclosure is thereby intended. Any alterations and further modifications, and any further applications of the principles of the disclosure as described herein are contemplated as would normally occur to one skilled in the art to which the disclosure relates. For the sake of clarity, some features not relevant to the present disclosure may not be shown in the drawings.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As one of ordinary skill would appreciate, different persons may refer to the same feature or component by different names. This document does not intend to distinguish between components or features that differ in name only. The figures are not necessarily to scale. Certain features and components herein may be shown exaggerated in scale or in schematic form and some details of conventional elements may not be shown in the interest of clarity and conciseness. When referring to the figures described herein, the same reference numerals may be referenced in multiple figures for the sake of simplicity. In the following description and in the claims, the terms "including" and "comprising" are used in an open-ended fashion, and thus, should be interpreted to mean "including, but not limited to."

The articles "the," "a" and "an" are not necessarily limited to mean only one, but rather are inclusive and open ended so as to include, optionally, multiple such elements.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating that insubstantial or inconsequential modifications or alterations of the subject matter described and are considered to be within the scope of the disclosure.

The term "heat exchanger" refers to a device designed to efficiently transfer or "exchange" heat from one matter to another. Exemplary heat exchanger types include a co-current or counter-current heat exchanger, an indirect heat exchanger (e.g. spiral wound heat exchanger, plate-fin heat exchanger such as a brazed aluminum plate fin type, shell-and-tube heat exchanger, etc.), direct contact heat exchanger, or some combination of these, and so on.

As previously described, the conventional LNG cycle includes: a) initial treatments of the natural gas resource to remove contaminants such as water, sulfur compounds and carbon dioxide; b) the separation of some heavier hydrocarbon gases, such as propane, butane, pentane, etc. by a variety of possible methods including self-refrigeration, external refrigeration, lean oil, etc.; c) refrigeration of the natural gas substantially by external refrigeration to form liquefied natural gas at or near atmospheric pressure and about −160° C.; d) removal of light components from the LNG such as nitrogen and helium; e) transport of the LNG product in ships or tankers designed for this purpose to a market location; and f) re-pressuriaztion and regasification of the LNG at a regasification plant to form a pressurized natural gas stream that may be distributed to natural gas consumers. Disclosed aspects herein generally involve liquefying natural gas using liquid nitrogen (LIN). In general, using LIN to produce LNG is a non-conventional LNG cycle in which step c) above is replaced by a natural gas liquefaction process that uses a significant amount of LIN as an open loop source of refrigeration, and in which step f) above may be modified to use the exergy of the cryogenic LNG to facilitate the liquefaction of nitrogen gas to form LIN that may then be transported to the resource location and used as a source of refrigeration for the production of LNG. The disclosed LIN-to-LNG concept may further include the transport of LNG in a ship or tanker from the resource location (export terminal) to the market location (import terminal) and the reverse transport of LIN from the market location to the resource location.

The disclosed aspects more specifically describe a method where step d), described above, is modified to include the use of liquid nitrogen to help separate nitrogen from the LNG stream. According to disclosed aspects, a method includes receiving liquid nitrogen produced at a location geographically separate from the LNG plant. A LNG stream having a nitrogen concentration greater than 1 mol % is directed to one or more separation vessels used to separate the LNG stream into a vapor stream and liquid stream, where the vapor stream has a nitrogen concentration greater than the LNG stream and the liquid stream has a nitrogen concentration less than the LNG stream. One or more liquid nitrogen streams are directed to one or more of the separation vessels used to separate nitrogen from the LNG. The separation vessels may be fractionation columns, distillation columns, adsorption columns, vertical separation vessels, horizontal separation vessels, or a combination thereof. The separation vessels may be any of the commonly known process equipment used to separate a vapor stream from a liquid stream. The separation vessels may be arranged in series, in parallel, or in a combination of series and parallel arrangements.

In one aspect, natural gas with a nitrogen concentration greater than 1 mol % may be liquefied to form a pressurized LNG stream. The pressurized LNG stream from a liquefaction process in a gas processing facility may flow through a hydraulic turbine to partially reduce its pressure and further cool the stream. The pressurized LNG stream may then be subcooled in a fractionation column reboiler where the column's liquid bottom is partially vaporized by exchanging heat with the pressurized LNG stream. The vapors from the column reboiler may be separated from the liquid stream and directed back to the fractionation column as the stripping gas used to reduce the nitrogen level in the LNG stream to less than 1 mol %. The subcooled pressurized LNG stream may be expanded in the inlet valves of the fractionation column to produce a two-phase mixture with preferably a vapor fraction of less than 40 mol %, or more preferably less 20 mol %. The two-phase mixture may be directed to the upper stages of the fractionation column. The separated liquid from the column reboiler is the LNG stream with less than 1 mol % nitrogen. The LNG stream may be pumped to one or more LNG storage tanks. Liquid nitrogen (LIN) from the one or more LIN storage tanks may be pumped to one or more stages within the fractionation column to form the column reflux that condenses most of the hydrocarbons in the upper stages of the fractionation column. The end-flash gas leaving from the overhead of the column may have a hydrocarbon concentration of less than 2 mol %, or more preferably may have a hydrocarbon concentration of less than 1 mol %. The end-flash gas may exchange heat with a treated natural gas stream to produce additional pressurized LNG that may be mixed with the main pressurized LNG stream. The warmed end-flash gas may be vented to the environment as nitrogen vent gas.

For a pressurized LNG stream with a nitrogen concentration of 4.5 mol %, the liquid nitrogen requirement for this proposed end-flash gas system is approximately 0.23 ton of liquid nitrogen for every ton of LNG produced. The proposed end-flash gas system increases overall LNG production by approximately 11%. This results in an effective liquid nitrogen to "extra"-LNG mass ratio of approximately 2.3. This end-flash gas system has the advantage of significantly reducing the equipment count since no compression of the end-flash gas is required. In contrast to the known systems, the boil-off gas system disclosed herein is minimally affected by the proposed end-flash gas system. The disclosed aspects have the additional advantage that fuel gas used in the gas turbines will be from boil-off gas and/or feed gas. Both these fuel gas streams have a low nitrogen concentration which may make them more suitable as fuel gas for gas turbines.

In a disclosed aspect, natural gas with a nitrogen concentration of greater than 1 mol % may be liquefied to form a pressurized LNG stream. The pressurized LNG stream may flow through a hydraulic turbine to partially reduce its pressure and further cool the stream. The pressurized LNG stream may then be subcooled in the LNG fractionation column reboiler where the column's liquid bottom is partially vaporized by exchanging heat with the pressurized LNG stream. The vapors from this column reboiler may be separated from the liquid stream and directed back to the LNG fractionation column as the stripping gas used to reduce the nitrogen level in the LNG stream to less than 1 mol %. The subcooled pressurized LNG stream may be expanded in the inlet valves of the LNG fractionation column to produce a two-phase mixture with preferably a vapor fraction of less than 40 mol %, or more preferably less 20 mol %. The two-phase mixture may be directed to the upper stages of the LNG fractionation column. The separated liquid from the column reboiler is the LNG stream with less than 1 mol % nitrogen. The LNG stream may be pumped to one or more LNG storage tanks. The end-flash gas leaving from the overhead of the LNG fractionation column may be partially condensed in the end-flash gas condenser by indirect heat exchange with a first stream of LIN from one or more LIN storage tanks. The partially condensed end-flash gas may be directed to the upper stages of a second fractionation column referred to as the nitrogen rejection column. A second stream of liquid nitrogen from the one or more LIN storage tanks may be pumped to one or more stages within the nitrogen rejection column and forms this column's reflux stream which acts to condense most of the hydrocarbon in the upper stages of the nitrogen rejection column. The mass flow of the second stream of liquid nitrogen may be preferably less than 10 wt % the mass flow of the first stream of liquid nitrogen, or more preferably, less than 5 wt % the mass flow of the first stream of liquid nitrogen. Boil-off gas from the one or more LNG storage tanks may directed to the bottom stages of the nitrogen rejection column to act as a stripping gas within the bottom stages of the nitrogen rejection column. The hydrocarbons within the boil-off gas may also be condensed in the nitrogen rejection column. The methane-rich liquid from the nitrogen rejection column may be pumped to the LNG fractionation column as a reflux stream for the LNG fractionation column. The overhead gas from the nitrogen rejection column may have a hydrocarbon concentration of less than 2 mol %, or more preferably a hydrocarbon concentration of less than 1 mol %. The overhead gas from the nitrogen rejection column and vaporized liquid nitrogen stream from the end-flash gas condenser may exchange heat with a treated natural gas stream to produce additional pressurized LNG that may be mixed with the main pressurized LNG stream. The warmed nitrogen streams may then be vented to the environment as nitrogen vent gas or used in other processes within the gas processing facility.

For a pressurized LNG stream with a nitrogen concentration of 4.5 mol %, the liquid nitrogen requirement for this proposed end-flash gas system is approximately 0.21 ton of liquid nitrogen for every ton of LNG produced. The end-flash gas system described herein increases overall LNG production by approximately 12%. This results in an effective liquid nitrogen to "extra"-LNG mass ratio of approximately 2.0. The end-flash gas system described herein reduces the equipment count of the end-flash gas system since no compression of the end-flash gas is required. Additionally, the end-flash gas system described herein eliminates the boil-off gas compression system since the hydrocarbons within the BOG are condensed in the nitrogen rejection column. Furthermore, the disclosed aspects have the advantage that fuel gas used in the gas turbines will be from feed natural gas which the fuel gas system receives at high pressure and high methane concentration. Additionally, the feed natural gas may not need to undergo the pretreatment steps of water and acid gas removal prior to being used as fuel for the gas turbines.

In another aspect, additional liquid nitrogen may be used in the end-flash gas system to reduce the required cooling of the pressurized LNG stream in the front-end liquefaction process. Natural gas with a nitrogen concentration of greater than 1 mol % may be liquefied in a liquefaction process of a gas processing facility to form a pressurized LNG stream. The pressurized LNG stream may have a temperature in the range of −100 to −150° C., or more preferably, the pressurized LNG stream has a temperature in range of −110 to −140° C. The pressurized LNG stream from the main cryogenic heat exchanger of the front-end liquefaction process may flow through a hydraulic turbine to partially reduce its pressure and cool the stream. The pressurized LNG stream may then be subcooled in a reboiler associated with an LNG fractionation column, where the fractionation column's liquid bottom is partially vaporized by exchanging heat with the pressurized LNG stream. The vapors from the LNG fractionation column reboiler may be separated from the liquid stream and directed back to the LNG fractionation column as the stripping gas used to reduce the nitrogen level in the LNG stream to less than 1 mol %. The subcooled pressurized LNG stream may be further subcooled by indirect heat exchange with the partially vaporized liquid nitrogen stream coming from the end-flash gas condenser. The further subcooled pressurized LNG stream may then be expanded in the inlet valves of the LNG fractionation column to produce a two-phase mixture with preferably a vapor fraction of less than 40 mol %, or more preferably less 20 mol %. The two-phase mixture may be directed to the upper stages of the LNG fractionation column. The separated liquid from the column reboiler is the LNG stream with less than 1 mol % nitrogen. The LNG stream may be pumped to one or more LNG storage tanks. The end-flash gas leaving the overhead of the column may be partially condensed in the end-flash gas condenser by indirect heat exchange with a first stream of liquid nitrogen from the LIN storage tanks. The mass flow of the first stream of liquid nitrogen to the end-flash gas condenser is sufficient that the liquid nitrogen stream is only partially vaporized after leaving the condenser. The partially condensed end-flash gas may be directed to the upper stages of a second fractionation column referred to as the nitrogen rejection column. A second stream of LIN from the LIN storage tanks may be pumped to one or more stages within the nitrogen rejection column and forms this column's reflux stream, which acts to condense most of the hydrocarbons in the upper stages of the nitrogen rejection column. The mass flow of the second stream of LIN is preferably less than 10 wt % the mass flow of the first stream of LIN, or more preferably, less than 5 wt % the mass flow of the first stream of LIN. Boil-off gas (BOG) from the LNG storage tanks may be directed to the bottom stages of the nitrogen rejection column to act as the stripping gas within the nitrogen rejection column. The hydrocarbons within the BOG may also be condensed in the nitrogen rejection column. The methane-rich liquid from the nitrogen rejection column may be pumped to the LNG fractionation column as a reflux stream therefor. The overhead gas from the nitrogen rejection column may have a hydrocarbon concentration of less than 2 mol %, or more preferably a hydrocarbon concentration of less than 1 mol %. The overhead gas from the nitrogen rejection column may exchange heat with a treated natural gas stream to produce an additional pressurized LNG stream that may be directly expanded into any of the stages of the LNG fractionation column. The warmed overhead gas stream may then be vented to the environment as a nitrogen vent gas or may be used in other processes of the gas processing facility. The partially vaporized first liquid nitrogen stream from the end-flash gas condenser may be fully vaporized in the liquid nitrogen subcooler. The vaporized first liquid nitrogen stream may exchange heat with a treated natural gas stream to produce an additional pressurized LNG stream that may be mixed with the main pressurized LNG stream. The warmed nitrogen stream may then be vented to the environment as a nitrogen vent gas or is used in other processes of the gas processing facility.

Figure 3:
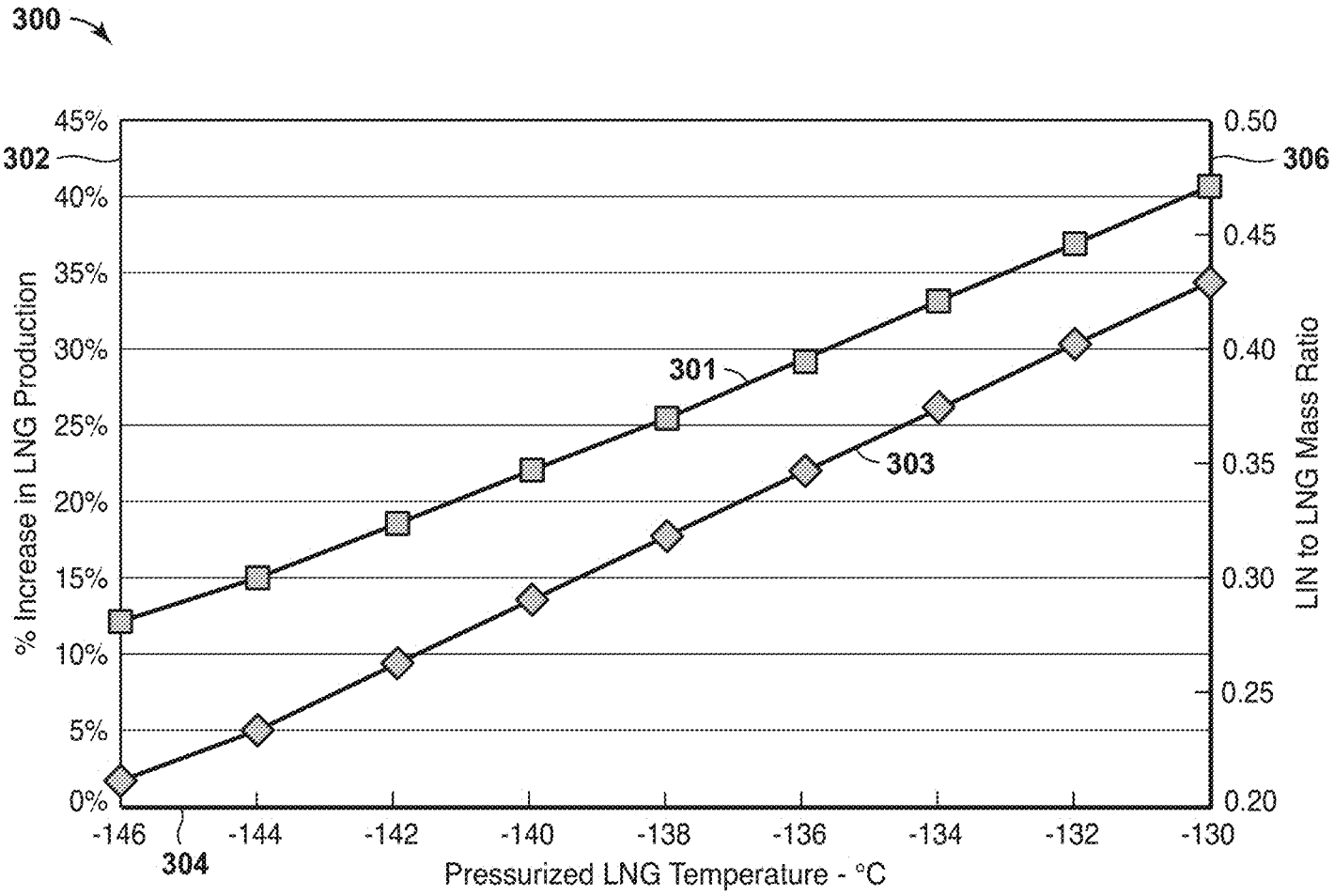
FIG. 3 is a graph showing the relationship between increases in LNG production versus LNG inlet temperature.

FIG. 3 is a plot 300 with a first set of data points 301 showing, as a function of pressurized LNG temperature that is measured along the horizontal axis 304, the estimated percent increase in LNG production (as measured along the left vertical axis 302) compared to the known end-flash gas system of FIG. 1. A second set of data points 303 shows, as a function of pressurized LNG temperature, the LIN-to-LNG ratio (as measured along the right vertical axis 306) for the disclosed end-flash gas system. The disclosed end-flash gas system has the advantage of allowing for a significant increase in LNG production without increasing required compression power for the main refrigeration unit and without increasing required topside space.

Figure 4:
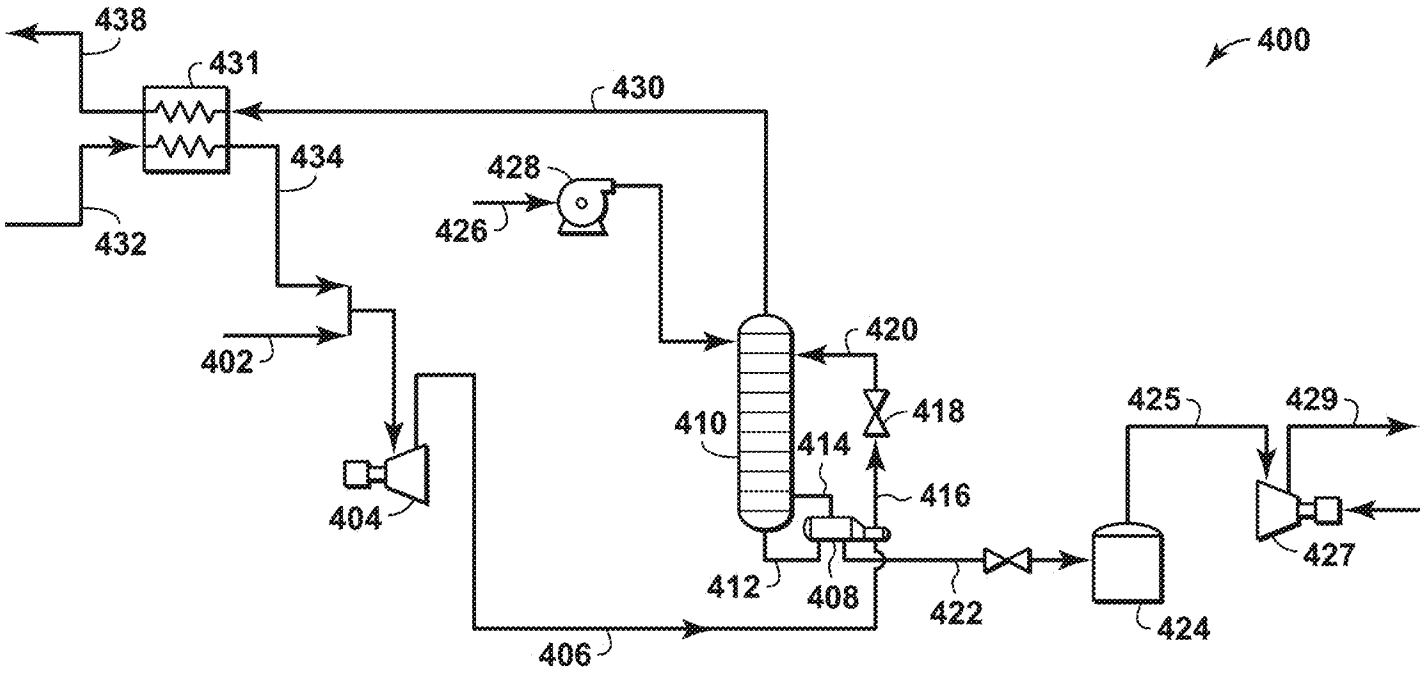
FIG. 4 is a schematic diagram of an end-flash gas system according to disclosed aspects.

FIG. 4 is an illustration of an end-flash gas system 400 according to an aspect of the disclosure. Natural gas with a nitrogen concentration of greater than 1 mol % may be liquefied in a liquefaction process of a gas processing facility (not shown) to form a pressurized LNG stream 402. The pressurized LNG stream 402 may flow through a hydraulic turbine 404 to partially reduce its pressure and further cool the pressurized LNG stream 402. The cooled pressurized LNG stream 406 may then be subcooled in a reboiler 408 associated with a separation vessel, which is depicted in FIG. 4 as a fractionation column 410. The liquid bottom stream 412 of the fractionation column 410 may be partially vaporized by exchanging heat with the cooled pressurized LNG stream 406. The vapors from the reboiler 408 may be separated from the liquid stream and directed back to the fractionation column 410 as a stripping gas stream 414 that may be used to reduce the nitrogen level in the LNG stream 422 to less than 1 mol %. The subcooled pressurized LNG stream 416 may be expanded in the inlet valves 418 of the fractionation column 410 to produce a two-phase mixture stream 420 with preferably a vapor fraction of less than 40 mol %, or more preferably less 20 mol %. The two-phase mixture stream 420 may be directed to the upper stages of the fractionation column 410. The separated liquid from the reboiler 408 is the LNG stream 422 and may have a composition of less than 1 mol % nitrogen. The LNG stream 422 may be directed to one or more LNG storage tanks 424. A boil-off gas (BOG) stream 425 from the one or more LNG storage tanks may be compressed in a BOG compressor 427 to generate a compressed fuel gas stream 429.

A liquid nitrogen (LIN) stream 426 may be pumped, using one or more pumps 428, to one or more stages within the fractionation column 410 to form the column reflux that condenses most of the hydrocarbons in the upper stages of the fractionation column 410. The LIN in LIN stream 426 is produced in a location geographically separate from the end-flash gas system 400. The production location of the LIN may be separated from the end-flash gas system by 50 miles, or 100 miles, or 200 miles, or 500 miles, or 1,000 miles, or greater than 1,000 miles. An end-flash gas stream 430 leaving from the overhead of the fractionation column 410 may have a hydrocarbon concentration of less than 2 mol %, or more preferably may have a hydrocarbon concentration of less than 1 mol %. The end-flash gas stream 430 may exchange heat in one or more heat exchangers 431 with a treated natural gas stream 432 to produce an additional pressurized LNG stream 434 that may be mixed with the pressurized LNG stream 402. The warmed end-flash gas stream may be vented to the environment as a nitrogen vent gas stream 438.

Figure 5:
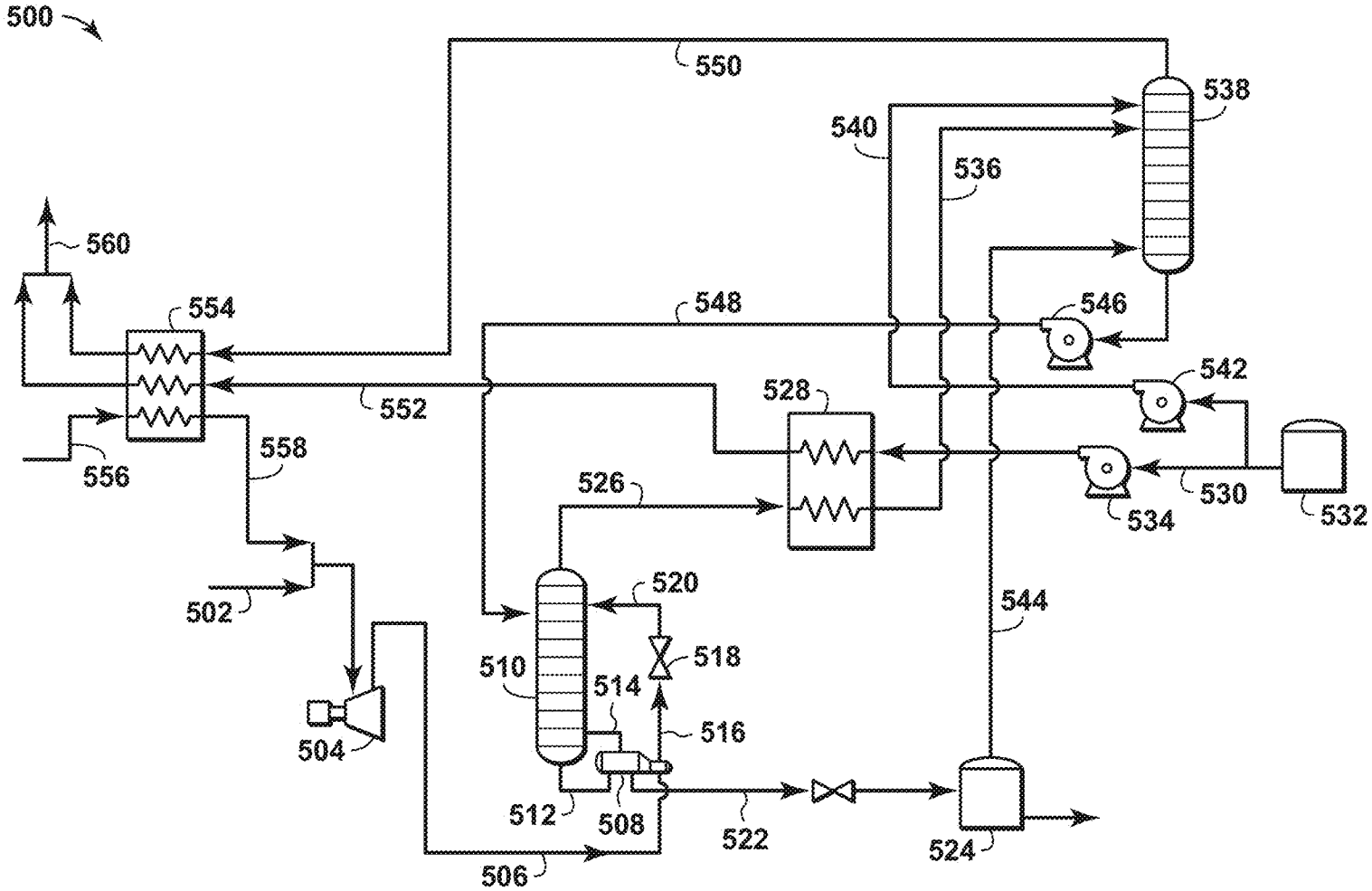
FIG. 5 is a schematic diagram of an end-flash gas system according to disclosed aspects.

FIG. 5 is an illustration of an end-flash gas system 500 according to another aspect. Natural gas with a nitrogen concentration of greater than 1 mol % may be liquefied in a liquefaction process of a gas processing facility (not shown) to form a pressurized LNG stream 502. The pressurized LNG stream 502 may flow through a hydraulic turbine 504 to partially reduce its pressure and further cool the pressurized LNG stream 502. The cooled pressurized LNG stream 506 may then be subcooled in a reboiler 508 associated with a separation vessel, which in FIG. 5 is depicted as an LNG fractionation column 510. The liquid bottom stream 512 of the LNG fractionation column 510 may be partially vaporized by exchanging heat with the cooled pressurized LNG stream 506. Vapors from the reboiler 508 may be separated from the liquid stream and directed back to the LNG fractionation column 510 as a stripping gas stream 514 that may be used to reduce the nitrogen level in the LNG stream 522 to less than 1 mol %. The subcooled pressurized LNG stream 516 may be expanded in the inlet valves 518 of the LNG fractionation column 510 to produce a two-phase mixture stream 520 with preferably a vapor fraction of less than 40 mol %, or more preferably less 20 mol %. The two-phase mixture stream 520 may be directed to the upper stages of the LNG fractionation column 510. The separated liquid from the reboiler 508 is the LNG stream 522 and may have a composition of less than 1 mol % nitrogen. The LNG stream 522 may be directed to one or more LNG storage tanks 524.

The end-flash gas stream 526 leaving the overhead of the LNG fractionation column 510 may be partially condensed in an end-flash gas condenser 528 by indirect heat exchange with a first liquid nitrogen (LIN) stream 530 pumped, using one or more pumps 534, from a LIN source, such as one or more LIN storage tanks 532. The LIN in the LIN source is produced in a location geographically separate from the end-flash gas system 500. The production location of the LIN may be separated from the end-flash gas system by 50 miles, or 100 miles, or 200 miles, or 500 miles, or 1,000 miles, or greater than 1,000 miles. A partially condensed end-flash gas stream 536 may be directed to the upper stages of a second separation vessel, which is shown as a second fractionation column referred to herein as a nitrogen rejection column 538. A second LIN stream 540 from a LIN source, which may be the same source providing the first LIN stream 530, such as the one or more LIN storage tanks 532, may be pumped using one or more pumps 542 to one or more stages within the nitrogen rejection column 538, thereby forming this column's reflux stream to condense most of the hydrocarbons in the upper stages of the nitrogen rejection column 538. The mass flow of the second LIN stream 540 is preferably less than 10 wt % the mass flow of the first LIN stream 530, or more preferably less than 5 wt % the mass flow of the first LIN stream 530. A boil-off gas (BOG) stream 544 from the one or more LNG storage tanks 524 may be directed to the bottom stages of the nitrogen rejection column 538 to act as a stripping gas therein. The hydrocarbons within the boil-off gas stream 544 may also be condensed in the nitrogen rejection column 538. The methane-rich liquid from the nitrogen rejection column 538 may be pumped, using one or more pumps 546, to the LNG fractionation column 510 as a reflux stream 548 for the LNG fractionation column 510. An overhead gas stream 550 from the nitrogen rejection column 538 may have a hydrocarbon concentration less than 2 mol %, or more preferably a hydrocarbon concentration less than 1 mol %. The overhead gas stream 550 and a vaporized liquid nitrogen stream 552 from the end-flash gas condenser 528 may exchange heat in a heat exchanger 554 with a treated natural gas stream 556 to produce an additional pressurized LNG stream 558 that may be mixed with the pressurized LNG stream 502. After being warmed in the heat exchanger 554, the overhead gas stream 550 and the vaporized liquid nitrogen stream 552 may be vented to the environment as a nitrogen vent gas stream 560, or may be used in other processes within the gas processing facility.

Figure 6:
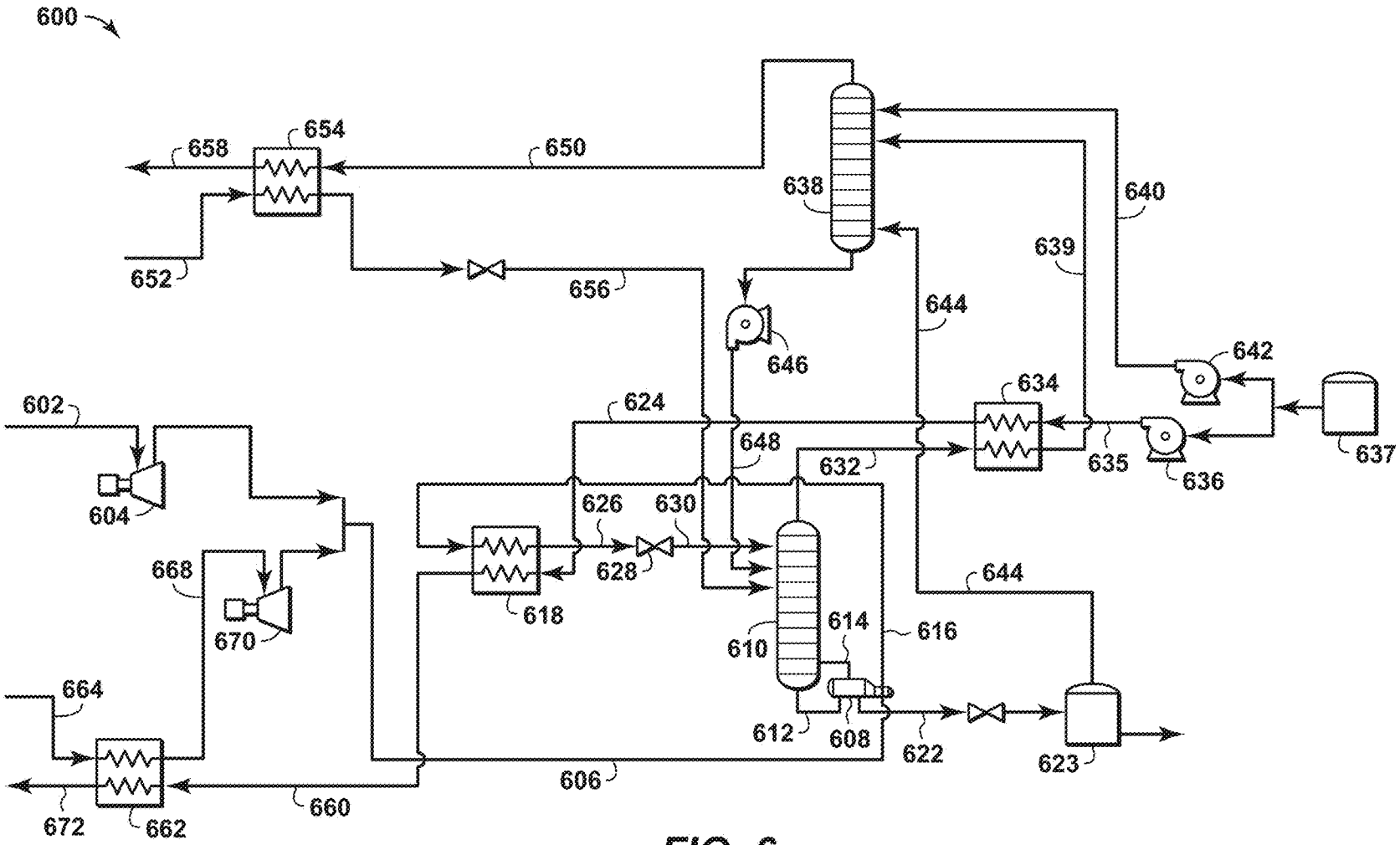
FIG. 6 is a schematic diagram of an end-flash gas system according to disclosed aspects.

FIG. 6 is an illustration of an end-flash gas system 600 according to another aspect. In this aspect, additional LIN may be used to reduce the required cooling of the incoming pressurized LNG stream. Natural gas with a nitrogen concentration of greater than 1 mol % may be liquefied in a liquefaction process in a gas processing facility (not shown) to form a pressurized LNG stream 602. The pressurized LNG stream 602 may have a temperature in the range of −100 to −150° C., or more preferably, a temperature in the range of −110 to −140° C. The pressurized LNG stream 602 may flow through a hydraulic turbine 604 to partially reduce its pressure and cool the pressurized LNG stream 602. The cooled pressurized LNG stream 606 may then be subcooled in a reboiler 608 associated with a separation vessel shown as an LNG fractionation column 610. The liquid bottom stream 612 of the LNG fractionation column 610 may be partially vaporized by exchanging heat with the cooled pressurized LNG stream 606. The vapors from the reboiler 608 may be separated from the liquid stream and directed back to the LNG fractionation column 610 as a stripping gas stream 614 that may be used to reduce the nitrogen level in an LNG stream 622 to less than 1 mol %. The subcooled pressurized LNG stream 616 may be further subcooled by indirect heat exchange in a first heat exchanger 618 with a partially vaporized liquid nitrogen stream 624 to form a further subcooled pressurized LNG stream 626. The further subcooled pressurized LNG stream 626 may then be expanded in the inlet valves 628 of the LNG fractionation column 610 to produce a two-phase mixture stream 630 with preferably a vapor fraction of less than 40 mol %, or more preferably less 20 mol %. The two-phase mixture stream 630 may be directed to the upper stages of the LNG fractionation column 610. The separated liquid from the reboiler 608 is the LNG stream 622 with less than 1 mol % nitrogen. The LNG stream 622 may be directed to one or more LNG storage tanks 623.

The end-flash gas stream 632 leaving the overhead of the LNG fractionation column 610 may be partially condensed in an end-flash gas condenser 634 by indirect heat exchange with a first LIN stream 635 pumped, using one or more pumps 636, from a LIN source, such as one or more LIN storage tanks 637. The LIN in the first LIN stream 635 is produced in a location geographically separate from the end-flash gas system 600. The production location of the LIN may be separated from the end-flash gas system by 50 miles, or 100 miles, or 200 miles, or 500 miles, or 1,000 miles, or greater than 1,000 miles. The mass flow of the first LIN stream 635 to the end-flash gas condenser 634 is sufficient that the first LIN stream 635 may be only partially vaporized after leaving the end-flash gas condenser 634. The partially condensed end-flash gas stream 639 may be directed to the upper stages of a second separation vessel, shown herein as a fractionation column and referred to herein as a nitrogen rejection column 638. A second LIN stream 640 from a LIN source, such as the one or more LIN storage tanks 637, may be pumped, using one or more pumps 642, to one or more stages within the nitrogen rejection column 638, thereby forming this column's reflux stream to condense most of the hydrocarbons in the upper stages of the nitrogen rejection column 638. The LIN in the second LIN stream 640 is produced in a location geographically separate from the end-flash gas system 600. The production location of the LIN may be separated from the end-flash gas system by 50 miles, or 100 miles, or 200 miles, or 500 miles, or 1,000 miles, or greater than 1,000 miles. The mass flow of the second LIN stream 640 is preferably less than 10 wt % of the mass flow of the first LIN stream 635, or more preferably less than 5 wt % of the mass flow of the first LIN stream 635.

A boil-off gas (BOG) stream 644 from the one or more LNG storage tanks 623 may be directed to the bottom stages of the nitrogen rejection column 638 to act as the stripping gas therein. The hydrocarbons within the boil-off gas stream 644 may also be condensed in the nitrogen rejection column 638. The methane-rich liquid from the nitrogen rejection column 638 may be pumped, using one or more pumps 646, to the LNG fractionation column 610 as a reflux stream 648 for the LNG fractionation column 610. An overhead gas stream 650 from the nitrogen rejection column 638 may have a hydrocarbon concentration of less than 2 mol %, or more preferably a hydrocarbon concentration of less than 1 mol %. The overhead gas stream 650 may exchange heat with a first treated natural gas stream 652 in a second heat exchanger 654 to produce a first additional pressurized LNG stream 656 that may be directly expanded into any of the stages of the LNG fractionation column 610. The warmed overhead gas stream 658 may then be vented to environment as a first nitrogen vent gas stream or may be used in other processes of the gas processing facility.

The partially vaporized LIN stream 624 from the end-flash gas condenser 634 may be fully or substantially fully vaporized in the first heat exchanger 618 to form a vaporized first LIN stream 660, which may exchange heat in a second heat exchanger 662 with a second treated natural gas stream 664 to produce a second additional pressurized LNG stream 668. The second additional pressurized LNG stream 668 may be passed through an expander 670, mixed with the pressurized LNG stream 602, and processed with the pressurized LNG stream 602 as described herein. The warmed nitrogen stream may then be vented to the environment as a second nitrogen vent gas 672 or is used in other processes of the gas processing facility.

Figure 7:
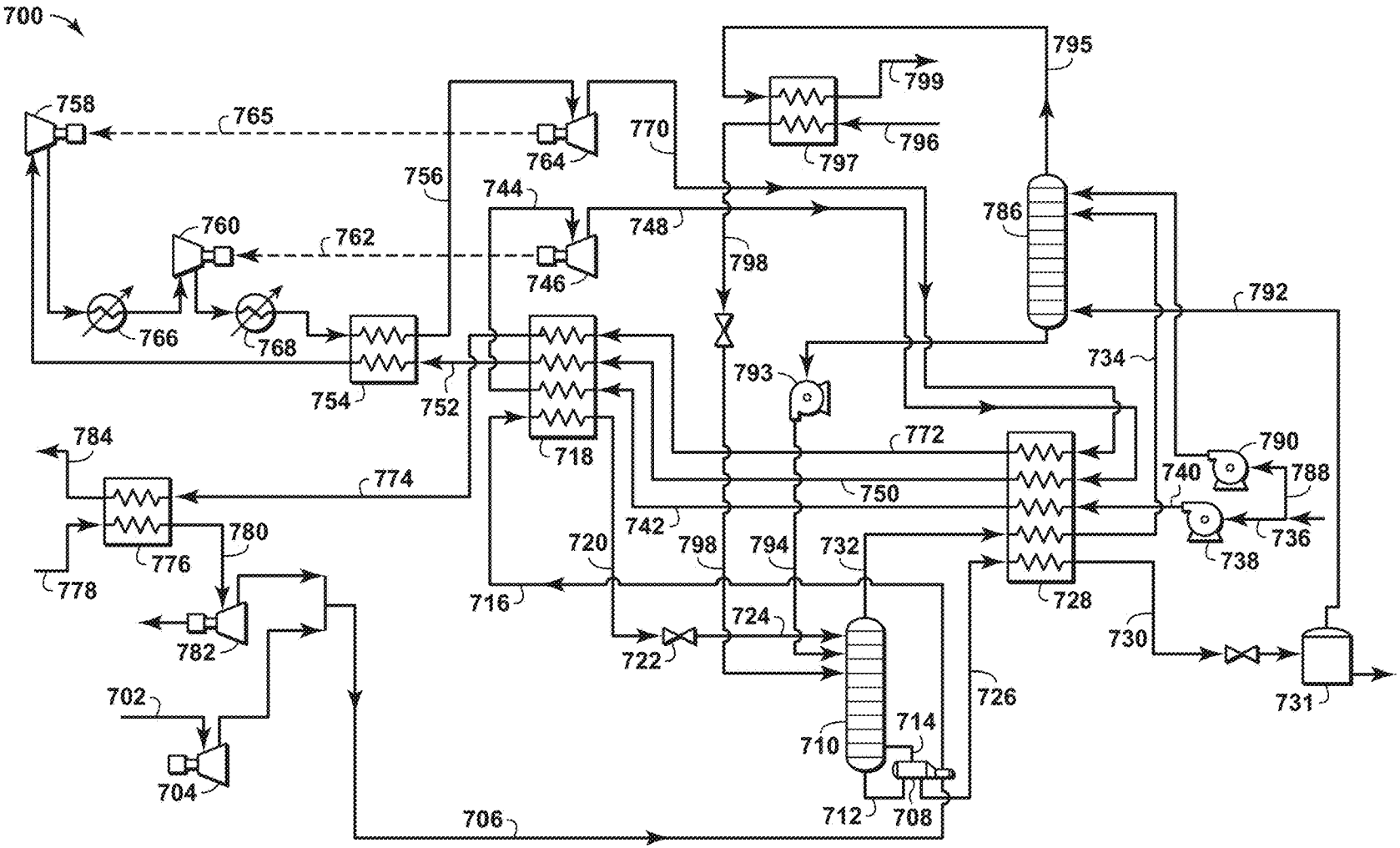
FIG. 7 is a schematic diagram of an end-flash gas system according to disclosed aspects.

FIG. 7 is an illustration of another aspect of the disclosure in which additional liquid nitrogen may be used in an end-flash gas system 700 to reduce the required cooling of a pressurized LNG stream in the front-end liquefaction process. Natural gas with a nitrogen concentration of greater than 1 mol % may be liquefied in an LNG liquefaction process in a gas processing facility (not shown) to form a pressurized LNG stream 702. The pressurized LNG stream 702 may have a temperature in the range of −100 to −150° C., or more preferably, in the range of −110 to −140° C. The pressurized LNG stream 702 may flow through a hydraulic turbine 704 to partially reduce its pressure and cool the stream. The cooled pressurized LNG stream 706 may then be subcooled in a reboiler 708 associated with a separation vessel, which is depicted as an LNG fractionation column 710. The liquid bottom stream 712 of the LNG fractionation column 710 may be partially vaporized by exchanging heat with the cooled pressurized LNG stream 706. The vapors from the reboiler 708 may be separated from the liquid stream and directed back to the LNG fractionation column 710 as a stripping gas stream 714 that may be used to reduce the nitrogen level in an LNG stream 726 to less than 1 mol %. The subcooled pressurized LNG stream 716 may be further subcooled by indirect heat exchange in a nitrogen subcooler 718 with various nitrogen gas cooling streams as further described herein, thereby forming a further-subcooled pressurized LNG stream 720. The nitrogen subcooler 718 may also be termed a first heat exchanger. The further-subcooled pressurized LNG stream 720 may then be expanded in the inlet valves 722 of the LNG fractionation column 710 to produce a two-phase mixture stream 724 with preferably a vapor fraction of less than 40 mol %, or more preferably less 20 mol %. The two-phase mixture stream 724 may be directed to the upper stages of the LNG fractionation column 710. The separated liquid from the column reboiler is the LNG stream 726 with less than 1 mol % nitrogen. The LNG stream 726 may be additionally cooled in a second heat exchanger, also called an end-flash gas condenser 728, to form a subcooled LNG stream 730. The subcooled LNG stream 730 may be directed to one or more LNG storage tanks 731.

The end-flash gas stream 732 leaving the overhead of the LNG fractionation column 710 may be partially condensed in the end-flash gas condenser 728 to form a partially condensed end-flash gas stream 734. A first LIN stream 736 may be pumped, using one or more pumps 738, to a pressure greater than 400 psi to form a high pressure liquid nitrogen stream 740. The LIN in the first LIN stream 736 is produced in a location geographically separate from the end-flash gas system 700. The production location of the LIN may be separated from the end-flash gas system by 50 miles, or 100 miles, or 200 miles, or 500 miles, or 1,000 miles, or greater than 1,000 miles. The high pressure liquid nitrogen stream 740 may exchange heat with the LNG stream 726 and the end-flash gas stream 732 in the end-flash gas condenser 728 to form a first intermediate nitrogen gas stream 742. The first intermediate nitrogen gas stream 742 may exchange heat with the subcooled pressurized LNG stream 716 in the nitrogen subcooler 718 to form a first warmed nitrogen gas stream 744. The first warmed nitrogen gas stream 744 may be expanded in a first nitrogen expander 746 to produce a first additionally cooled nitrogen gas stream 748. The first additionally cooled nitrogen gas stream 748 may exchange heat with the LNG stream 726 and the end-flash gas stream 732 in the end-flash gas condenser 728 to form a second intermediate nitrogen gas stream 750. The second intermediate nitrogen gas stream 750 may also exchange heat with the subcooled pressurized LNG stream 716 in the nitrogen subcooler 718 to form a second warmed nitrogen gas stream 752. The second warmed nitrogen gas stream 752 may indirectly exchange heat in a third heat exchanger 754 with other process streams prior to being compressed in two or more compressor stages to form a compressed nitrogen gas stream 756. The two or more compressor stages may include a first compressor stage 758 and a second compressor stage 760. The second compressor stage 760 may be driven solely by the shaft power produced by the first nitrogen expander 746, as indicated by dashed line 762. The first compressor stage 758 may be driven solely by the shaft power produced by a second nitrogen expander 764, as indicated by dashed line 765. After each compression stage, the compressed nitrogen gas stream 756 may be cooled by indirect heat exchange with the environment in one or more coolers 766, 768 after each compression stage. The compressed nitrogen gas stream 756 may be expanded in the second nitrogen expander 764 to produce a second additionally cooled nitrogen gas stream 770. The second additionally cooled nitrogen gas stream 770 may exchange heat with the LNG stream 726 and the end-flash gas stream 732 in the end-flash gas condenser 728 to form a third intermediate nitrogen gas stream 772. The third intermediate nitrogen gas stream 772 may exchange heat with the subcooled pressurized LNG stream 716 in the nitrogen subcooler 718 to form a third warmed nitrogen gas stream 774. The third warmed nitrogen gas stream 774 may be directed to a fourth heat exchanger 776 to liquefy a first treated natural gas stream 778 and form a first additional pressurized LNG stream 780. The first additional pressurized LNG stream 780 may be mixed with the pressurized LNG stream 702 prior to the cooling of the pressurized LNG stream 702. The first additional pressurized LNG stream 780 may be reduced in pressure in a hydraulic turbine 782 prior to mixing with the pressurized LNG stream 702. The third warmed nitrogen gas stream 774 may be heated by the first treated natural gas stream 778 in the fourth heat exchanger 776 to form a first nitrogen vent gas stream 784 that may be vented to the atmosphere or used in other areas of the gas processing facility.

As illustrated in FIG. 7, the subcooled pressurized LNG stream 716 may be further subcooled by exchanging heat in the nitrogen subcooler 718 with the first intermediate nitrogen gas stream 742, the second intermediate nitrogen gas stream 750, and the third intermediate nitrogen gas stream 772, to form the further-subcooled pressurized LNG stream 720. The LNG stream 726 may be subcooled by exchanging heat in the end-flash gas condenser 728 with the high pressure liquid nitrogen stream 740, the first additionally cooled nitrogen gas stream 748, and the second additionally cooled nitrogen gas stream 770 to form the subcooled LNG stream 730. Additionally, the end-flash gas stream 732 may be partially condensed by exchanging heat in the end-flash gas condenser 728 with the high pressure liquid nitrogen stream 740, the first additionally cooled nitrogen gas stream 748, and the second additionally cooled nitrogen gas stream 770 to form the partially condensed end-flash gas stream 734. The partially condensed end-flash gas stream 734 may be directed to the upper stages of a second separation vessel, shown herein as a fractionation column and referred to as the nitrogen rejection column 786. A second LIN stream 788 from an LIN source, such as one or more LIN tanks (not shown), may be pumped using one or more pumps 790 to one or more stages within the nitrogen rejection column 786. The LIN in the second LIN stream 788 is produced in a location geographically separate from the end-flash gas system 700. The production location of the LIN may be separated from the end-flash gas system by 50 miles, or 100 miles, or 200 miles, or 500 miles, or 1,000 miles, or greater than 1,000 miles. The second LIN stream 788 may form the reflux stream of the nitrogen rejection column 786, and acts to condense most of the hydrocarbons in the upper stages of the nitrogen rejection column 786. The mass flow of the second LIN stream 788 may preferably be less than 10 wt %, or more preferably, less than 5 wt %, of the mass flow of the first liquid nitrogen stream 736. A boil-off gas stream 792 from the one or more LNG storage tanks 731 may be directed to the bottom stages of the nitrogen rejection column 786 to act as the stripping gas therein. The hydrocarbons within the boil-off gas stream 792 may also be condensed in the nitrogen rejection column 786. The methane-rich bottoms liquid from the nitrogen rejection column 786 may be pumped, using one or more pumps 793, to the LNG fractionation column 710 as a reflux stream 794 for the LNG fractionation column 710. An overhead gas stream 795 from the nitrogen rejection column 786 may have a hydrocarbon concentration of less than 2 mol %, or more preferably may have a hydrocarbon concentration of less than 1 mol %. The overhead gas stream 795 from the nitrogen rejection column 786 may exchange heat with a second treated natural gas stream 796 in a fifth heat exchanger 797 to produce a second additional pressurized LNG stream 798 that may be directly expanded into any of the stages of the LNG fractionation column 710. After passing through the fifth heat exchanger 797, the overhead gas stream 795 may be vented to the environment as a second nitrogen vent gas stream 799 or used in other areas of the gas processing facility. The end-flash gas system 700 illustrated in FIG. 7 reduces the LIN requirement by approximately 20 to 25% compared to the simpler end-flash gas system illustrated in FIG. 6. The optimal choice for the end-flash gas system will depend on criteria such as cost of liquid nitrogen and available topside space.

The aspects described above and shown in FIGS. 4-7 disclose separation vessels to separate LNG and nitrogen. The separation vessels are depicted as fractionation columns, but may comprise any of the commonly known process equipment used to separate a vapor stream from a liquid stream, such as distillation columns, adsorption columns or any combination thereof. The separation vessels may be oriented horizontally or vertically. Multiple separation vessels (if used) may be arranged in series, in parallel, or in a combination of series and parallel arrangements. Additionally, the liquefaction process used to produce the pressurized LNG stream may be a single mixed refrigerant process, a propane pre-cooled mixed refrigerant process, a cascade refrigerant process, a dual mixed refrigerant process, or an expander-based liquefaction process. In an aspect, the liquefaction process is a LIN refrigeration process where LIN is used as the sole or primary open loop source of refrigeration, such as the LIN refrigeration process disclosed in U.S. Provisional Patent Application No. 62/192,657, filed Jul. 15, 2015 and titled "Increasing Efficiency in an LNG Production System by Pre-Cooling a Natural Gas Feed Stream," the disclosure of which is incorporated by reference herein in its entirety.

Figure 8:
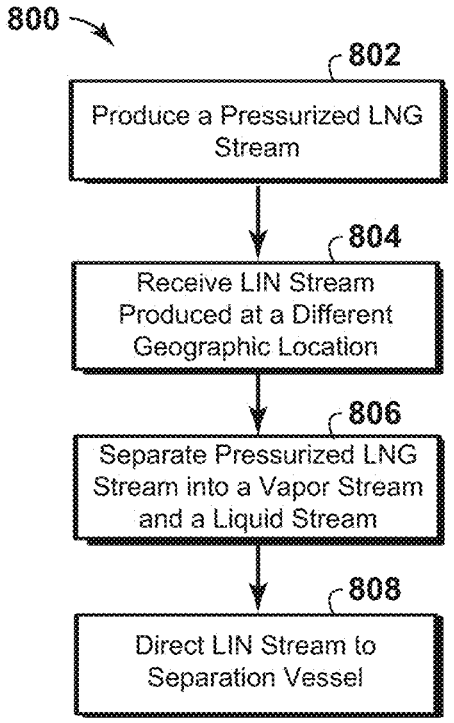
FIG. 8 is a flowchart showing a method according to disclosed aspects.

FIG. 8 is a flowchart of a method 800 for separating nitrogen from an LNG stream with a nitrogen concentration of greater than 1 mol %, according to disclosed aspects. At block 802 a pressurized LNG stream is produced at a liquefaction facility by liquefying natural gas, where the pressurized LNG stream has a nitrogen concentration of greater than 1 mol %. At block 804 at least one liquid nitrogen (LIN) stream is received from storage tanks, the at least one LIN stream being produced at a different geographic location from the LNG facility. At block 806 the pressurized LNG stream is separated in a separation vessel into a vapor stream and a liquid stream. The vapor stream has a nitrogen concentration greater than the nitrogen concentration of the pressurized LNG stream. The liquid stream has a nitrogen concentration less than the nitrogen concentration of the pressurized LNG stream. At block 808 at least one of the one or more LIN streams is directed to the separation vessel.

Disclosed aspects may include any combinations of the methods and systems shown in the following numbered paragraphs. This is not to be considered a complete listing of all possible aspects, as any number of variations can be envisioned from the description above.

1. A method for separating nitrogen from an LNG stream with a nitrogen concentration of greater than 1 mol %, comprising:

at a liquefaction facility, producing a pressurized LNG stream by liquefying natural gas, where the pressurized LNG stream comprises a nitrogen concentration of greater than 1 mol %;

receiving at least one liquid nitrogen (LIN) stream from storage tanks, the at least one LIN stream being produced at a different geographic location from the LNG facility;

in a separation vessel, separating the pressurized LNG stream into a vapor stream and a liquid stream, where the vapor stream has a nitrogen concentration greater than the nitrogen concentration of the pressurized LNG stream and the liquid stream has a nitrogen concentration less than the nitrogen concentration of the pressurized LNG stream; and directing at least one of the one or more LIN streams to the separation vessel.

2. The method of paragraph 1, wherein the liquid stream is an LNG stream with a nitrogen concentration of less than 2 mol % or less than 1 mol %.

3. The method of paragraphs 1 or 2, wherein the LNG stream is subcooled by indirect heat exchange with at least one of the one or more LIN streams.

4. The method of any of paragraphs 1-3, wherein the vapor stream is a cold nitrogen vent stream with a hydrocarbon concentration of less than 2 mol % or less than 1 mol %.

5. The method of paragraph 4, wherein the cold nitrogen vent stream is used to liquefy a natural gas stream to form an additional pressurized LNG stream and a warm nitrogen vent stream.

6. The method of any of paragraphs 1-5, wherein the separation vessel is a first separation vessel, and further comprising directing LNG boil-off gas to a second separation vessel.

7. The method of paragraph 6, further comprising directing all or a portion of the vapor stream to the second separation vessel.

8. The method of paragraph 7, wherein one of the at least one LIN streams is directed to the second separation vessel.

9. The method of paragraph 6, wherein:

the second separation vessel is a multi-stage separation column;

the boil-off gas is a stripping gas for the multi-stage separation column; and hydrocarbons within the boil-off gas are condensed in the multi-stage separation column.

10. The method of paragraph 9, wherein one of the at least one LIN streams is directed to the multi-stage separation column.

11. The method of any of paragraphs 1-10, further comprising partially or fully condensing the vapor stream by indirect heat exchange with one or more of the at least one LIN stream, to thereby form a condensed vapor stream and a vaporized LIN stream.

12. The method of paragraph 11, wherein the separation vessel is a first separation vessel, the vapor stream is a first vapor stream and the liquid stream is a first liquid stream, and further comprising directing the condensed vapor stream into a second separation vessel to form a second vapor stream and a second liquid stream.

13. The method of paragraph 12, further comprising directing the second liquid stream into the first separation vessel as a reflux stream to the first separation vessel.

14. The method of paragraph 12, further comprising directing one of the at least one LIN streams to the second separation vessel to condense a majority of hydrocarbon components present in the second separation vessel such that the second vapor stream is substantially free of hydrocarbons.

15. The method of any of paragraphs 12-14, wherein the second vapor stream is a cold nitrogen vent stream with a hydrocarbon concentration of less than 2 mol % or less than 1 mol %.

16. The method of any of paragraphs 1-15, further comprising subcooling the pressurized LNG stream by indirect heat exchange with one or more of the at least one LIN streams, to form a subcooled pressurized LNG stream and a vaporized LIN stream.

17. The method of any of paragraphs 10-16, further comprising:

using the vaporized LIN stream to liquefy a natural gas stream to form an additional pressurized LNG stream and a warm nitrogen vent stream.

18. The method of any of paragraphs 10-17, further comprising:

cooling inlet air to one or more turbines using the warm nitrogen vent stream.

19. The method of any of paragraphs 1-18, further comprising partially or fully condensing the vapor stream by indirect heat exchange with one of the at least one LIN streams to form a condensed vapor stream and a warmed nitrogen gas stream, wherein the one of the at least one LIN streams has a pressure greater than 400 psia.

20. The method of paragraph 19, further comprising reducing the pressure of the warmed nitrogen gas stream in at least one expander service to produce at least one additionally cooled nitrogen gas stream.

21. The method of paragraph 20, further comprising exchanging heat between the at least one additionally cooled nitrogen gas stream and the vapor stream to form a partially or fully condensed vapor stream and a warmed nitrogen gas stream.

22. The method of paragraphs 20 or 21, further comprising coupling the at least one expander service with at least one compressor used to compress the warmed nitrogen gas stream.

23. The method of any of paragraphs 2-22, wherein the pressurized LNG stream has a temperature in the range of −100° C. to −150° C.

24. The method of any of paragraphs 1-23, further comprising producing the at least one LIN stream from nitrogen gas by exchanging heat with a transported LNG stream during regasification of the LNG stream regasification.

25. The method of any of paragraphs 1-24, further comprising expanding the pressurized LNG stream to produce a two-phase mixture with a vapor fraction of less than 40 mol %.

26. The method of any of paragraphs 1-25, further comprising expanding the pressurized LNG stream to produce a two-phase mixture with a vapor fraction of less than 20 mol %.

27. The method of any of paragraphs 1-26, wherein the liquefaction process used to produce the pressurized LNG stream is a single mix refrigerant process, a propane precooled mixed refrigerant process, a cascade refrigerant process, a duel mixed refrigerant process, or an expander-based liquefaction process.

28. The method of any of paragraphs 1-27, wherein the liquefaction process used to produce the pressurized LNG stream is a liquid nitrogen refrigeration process, where liquid nitrogen is substantially used as an open loop source of refrigeration in the liquid nitrogen refrigeration process.

29. A system for processing pressurized liquefied natural gas (LNG) produced at a liquefied natural gas (LNG) liquefaction facility, the LNG having a nitrogen concentration greater than 1 mol %, comprising:

a separation vessel configured to separate the pressurized LNG stream into a vapor stream and a liquid stream, where the vapor stream has a nitrogen concentration greater than the nitrogen concentration of the pressurized LNG stream and the liquid stream has a nitrogen concentration less than the nitrogen concentration of the pressurized LNG stream; and a liquefied nitrogen (LIN) stream produced at a different geographic location from the LNG liquefaction facility and configured to be directed into the separation vessel.

30. The system of paragraph 29, further comprising a first heat exchanger configured to subcool the pressurized LNG stream by heat exchange with the LIN stream.

31. The system of paragraphs 29 or 30, wherein the vapor stream is a cold nitrogen vent stream with a hydrocarbon concentration of less than 2 mol % or less than 1 mol %, and further comprising a second heat exchanger configured to liquefy a natural gas stream to form an additional pressurized LNG stream by heat exchange with the cold nitrogen vent stream, forming a warm nitrogen vent stream therefrom.

32. The system of any of paragraphs 29-31, wherein the separation vessel is a first separation vessel, and further comprising a second separation vessel to which LNG boil-off gas is directed.

33. The system of paragraph 32, wherein all or a portion of the vapor stream is directed to the second separation vessel.

34. The system of paragraph 33, wherein at least part of the LIN stream is directed to the second separation vessel.

35. The system of any of paragraphs 29-34, further comprising a third heat exchanger that partially or fully condenses the vapor stream by indirect heat exchange with at least part of the LIN stream to form a condensed vapor stream and a warmed nitrogen gas stream, wherein the at least part of the LIN stream has a pressure greater than 400 psia.

36. The system of paragraph 35, further comprising an expander service configured to reduce the pressure of the warmed nitrogen gas stream to produce at least one additionally cooled nitrogen gas stream.

37. The system of paragraph 36, further comprising a fourth heat exchanger that exchanges heat between the at least one additionally cooled nitrogen gas stream and the vapor stream to form a partially or fully condensed vapor stream and a warmed nitrogen gas stream.

38. The system of paragraphs 36 or 37, further comprising a compressor coupled to the expander service, wherein the compressor is used to compress the warmed nitrogen gas stream.

39. The system of any of paragraphs 29-38, wherein the pressurized LNG stream has a temperature in the range of −100° C. to −150° C.

40. The system of any of paragraphs 29-39, wherein the LIN stream is produced from nitrogen gas by exchanging heat with a transported LNG stream during regasification of the LNG stream regasification.

41. The system of any of paragraphs 29-40, wherein the liquefaction process used to produce the pressurized LNG stream is a single mix refrigerant process, a propane pre-cooled mixed refrigerant process, a cascade refrigerant process, a duel mixed refrigerant process, or an expander-based liquefaction process.

42. The system of any of paragraphs 29-41, wherein the liquefaction process used to produce the pressurized LNG stream is a liquid nitrogen refrigeration process, where liquid nitrogen is substantially used as an open loop source of refrigeration in the liquid nitrogen refrigeration process.

It should be understood that the numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

What is claimed is:

1. A method for separating nitrogen from a pressurized LNG stream with a nitrogen concentration of greater than 1 mol %, comprising:

at a liquefaction facility, producing the pressurized LNG stream by liquefying natural gas, where the pressurized LNG stream comprises a nitrogen concentration of greater than 1 mol %;

receiving at least one liquid nitrogen (LIN) stream, the at least one LIN stream being produced at a different geographic location from the liquefaction facility;

directing the at least one LIN stream to a separation vessel;

directing the pressurized LNG stream to the separation vessel;

in the separation vessel, using the at least one LIN stream to separate the pressurized LNG stream into a vapor stream and a liquid stream, where the vapor stream has a nitrogen concentration greater than the nitrogen concentration of the pressurized LNG stream and the liquid stream has a nitrogen concentration less than the nitrogen concentration of the pressurized LNG stream;

using the vapor stream to liquefy a natural gas stream to form an additional pressurized LNG stream and a warm nitrogen vent stream; and combining the additional pressurized LNG stream with the pressurized LNG stream upstream of the separation vessel.

2. The method of claim 1, wherein the liquid stream is an LNG stream with a nitrogen concentration of less than 2 mol %.

3. The method of claim 1, further comprising subcooling the LNG stream by indirect heat exchange with at least one of the one or more LIN streams.

4. The method of claim 1, wherein the vapor stream is a cold nitrogen vent stream with a hydrocarbon concentration of less than 2 mol %, and further comprising:

using the cold nitrogen vent stream to liquefy the natural gas stream to form the additional pressurized LNG stream and the warm nitrogen vent stream.

5. The method of claim 1, wherein the separation vessel is a first separation vessel, and further comprising directing LNG boil-off gas to a second separation vessel.

6. The method of claim 5, further comprising:

after separating the pressurized LNG stream into the vapor stream and the liquid stream, directing all or a portion of the vapor stream to the second separation vessel; and directing another of the at least one LIN streams to the second separation vessel.

7. The method of claim 5, wherein the second separation vessel is a multi-stage separation column, and the boil-off gas is a stripping gas for the multi-stage separation column, the method further comprising:

condensing, in the multi-stage separation column, hydrocarbons within the boil-off gas; and directing another of the at least one LIN streams to the multi-stage separation column.

8. The method of claim 1, wherein the separation vessel is a first separation vessel, the vapor stream is a first vapor stream and the liquid stream is a first liquid stream, and further comprising:

partially or fully condensing the first vapor stream by indirect heat exchange with another of the at least one LIN stream, to thereby form a condensed first vapor stream and a vaporized LIN stream; and directing the first condensed vapor stream into a second separation vessel to form a second vapor stream and a second liquid stream.

9. The method of claim 8, further comprising directing the second liquid stream into the first separation vessel as a reflux stream to the first separation vessel.

10. The method of claim 8, further comprising directing another of the at least one LIN streams to the second separation vessel to condense a majority of hydrocarbon components present in the second separation vessel such that the second vapor stream is substantially free of hydrocarbons.

11. The method of claim 8, wherein the second vapor stream is a cold nitrogen vent stream with a hydrocarbon concentration of less than 2 mol % or less than 1 mol %.

12. The method of claim 1, further comprising subcooling the pressurized LNG stream by indirect heat exchange with one or more of the at least one LIN streams, to form a subcooled pressurized LNG stream and a vaporized LIN stream.

13. The method of claim 7, further comprising:

cooling inlet air to one or more turbines using the warm nitrogen vent stream.

14. The method of claim 1, further comprising:

after separating the pressurized LNG stream into the vapor stream and the liquid stream, partially or fully condensing the vapor stream by indirect heat exchange with one of the at least one LIN streams to form a condensed vapor stream and a warmed nitrogen gas stream, wherein the one of the at least one LIN streams has a pressure greater than 400 psia, wherein vapor separated from the condensed vapor stream is used to liquefy the natural gas stream to form the additional pressurized LNG stream;

reducing the pressure of the warmed nitrogen gas stream in at least one expander service to produce at least one additionally cooled nitrogen gas stream;

exchanging heat between the at least one additionally cooled nitrogen gas stream and the vapor stream to form a partially or fully condensed vapor stream and a warmed nitrogen gas stream; and coupling the at least one expander service with at least one compressor used to compress the warmed nitrogen gas stream.

15. The method of claim 1, wherein the pressurized LNG stream has a temperature in the range of −100° C. to −150° C.

16. The method of claim 1, wherein the different geographic location is an LNG regasification facility, the method further comprising:

transporting the pressurized LNG to the regasification facility to produce a transported LNG stream;

regasifying the transported LNG stream at the LNG regasification facility;

producing the at least one LIN stream from nitrogen gas by exchanging heat with the transported LNG stream during regasification of the transported LNG stream.

17. The method of claim 1, further comprising expanding the pressurized LNG stream to produce a two-phase mixture with a vapor fraction of less than 40 mol %.

18. The method of claim 1, further comprising expanding the pressurized LNG stream to produce a two-phase mixture with a vapor fraction of less than 20 mol %.

19. The method of claim 1, wherein the liquefaction process used to produce the pressurized LNG stream is a single mix refrigerant process, a propane pre-cooled mixed refrigerant process, a cascade refrigerant process, a dual mixed refrigerant process, or an expander-based liquefaction process.

20. The method of claim 1, wherein the liquefaction process used to produce the pressurized LNG stream is a liquid nitrogen refrigeration process, where liquid nitrogen is substantially used as an open loop source of refrigeration in the liquid nitrogen refrigeration process.

21. A system for processing pressurized liquefied natural gas (LNG) produced at a liquefied natural gas (LNG) liquefaction facility, the pressurized LNG having a nitrogen concentration greater than 1 mol %, comprising:

a liquefied nitrogen (LIN) stream produced at a different geographic location from the LNG liquefaction facility;

a separation vessel into which the pressurized LNG stream and the LIN stream are directed, the separation vessel configured use the LIN stream to separate the pressurized LNG stream into a vapor stream and a liquid stream, where the vapor stream has a nitrogen concentration greater than the nitrogen concentration of the pressurized LNG stream and the liquid stream has a nitrogen concentration less than the nitrogen concentration of the pressurized LNG stream; and a heat exchanger that uses the vapor stream to liquefy a natural gas stream to form an additional pressurized LNG stream and a warm nitrogen vent stream;

wherein the additional pressurized LNG stream is combined with the pressurized LNG stream upstream of the separation vessel.

22. The system of claim 21, wherein the vapor stream is a cold nitrogen vent stream with a hydrocarbon concentration of less than 2 mol % or less than 1 mol %.

23. The system of claim 21, wherein the separation vessel is a first separation vessel, and further comprising a second separation vessel to which LNG boil-off gas is directed;

wherein all or a portion of the vapor stream is directed to the second separation vessel, and wherein at least part of the LIN stream is directed to the second separation vessel.

24. The system of claim 22, further comprising:

a second heat exchanger that partially or fully condenses the vapor stream by indirect heat exchange with at least part of the LIN stream to form a condensed vapor stream and a warmed nitrogen gas stream, wherein the at least part of the LIN stream has a pressure greater than 400 psia;

an expander service configured to reduce the pressure of the warmed nitrogen gas stream to produce at least one additionally cooled nitrogen gas stream;

a third heat exchanger that exchanges heat between the at least one additionally cooled nitrogen gas stream and the vapor stream to form a partially or fully condensed vapor stream and a warmed nitrogen gas stream; and a compressor coupled to the expander service, wherein the compressor is used to compress the warmed nitrogen gas stream.

* * * * *